US005246133A

United States Patent [19]

James

[11] Patent Number: 5,246,133

[45] Date of Patent: Sep. 21, 1993

[54] INJECTION MOLDED LID WITH WINDOW

[75] Inventor: Thomas L. James, Johnson County, Kans.

[73] Assignee: Sealright Co., Inc., Overland Park, Kans.

[21] Appl. No.: 951,320

[22] Filed: Sep. 25, 1992

Related U.S. Application Data

[63] Continuation of Ser. No. 760,387, Sep. 16, 1991, abandoned.

[51] Int. Cl.[5] ..... B65D 51/22

[52] U.S. Cl. ..... 220/377; 220/602

[58] Field of Search ..... 220/602, 377, 254, 662; 215/250, 230

[56] References Cited

U.S. PATENT DOCUMENTS

| | | | |
|---|---|---|---|
| D. 291,971 | 9/1987 | Smith . | |
| D. 321,477 | 11/1991 | Gunter . | |
| 1,215,114 | 2/1917 | Cohen | 215/230 |
| 1,961,137 | 6/1934 | Haan | 220/377 |
| 1,975,703 | 10/1934 | Vitale . | |
| 2,047,951 | 7/1936 | Eberhart | 220/377 |
| 2,549,917 | 4/1951 | Milbrandt | 220/377 |
| 3,122,990 | 3/1964 | Fried | 220/377 |
| 3,489,307 | 1/1970 | Wenger | 215/230 |
| 4,747,499 | 5/1988 | Gach et al. | 220/377 |
| 4,747,500 | 5/1988 | Gach et al. | 220/377 |
| 4,801,029 | 1/1989 | Begley | 215/250 |
| 5,035,341 | 7/1991 | Heilman et al. | 215/230 |

FOREIGN PATENT DOCUMENTS

| | | | |
|---|---|---|---|
| 833462 | 3/1952 | Fed. Rep. of Germany | 220/602 |
| 338166 | 3/1936 | Italy | 215/250 |

*Primary Examiner*—Allan N. Shoap
*Assistant Examiner*—S. Castellano
*Attorney, Agent, or Firm*—Kokjer, Kircher, Bowman & Johnson

[57] ABSTRACT

The present invention includes an injection molded lid comprising a closed annular rim, a skirt fixed to and extending downwardly from the rim and a film sealed to the bottom side of the rim to cover the open space within the rim. The rim and skirt are molded as a single monolithic lid preform, with the skirt being fixed near the outer peripheral edge of the rim. The film is sealed along the inner peripheral edge on the bottom side of the rim. This device allows for a prospective consumer to view the contents of the container before purchasing it. In addition to the lid device, a method is provided of forming a closure to seal a food container. A lid preform is injection molded as a monolithic unit comprising a skirt and a closed rim. Then the film is sealed along the entire length of the inner peripheral edge on the bottom side of the rim. This method allows for forming a sturdy closure capable of maintaining the integrity of its original seal with the container as well as its seal with the film.

11 Claims, 1 Drawing Sheet

INJECTION MOLDED LID WITH WINDOW

This is a continuation of application Ser. No. 07/760,387, filed Sep. 16, 1991 now abandoned.

BACKGROUND OF THE INVENTION

1. Field of the Invention

The present invention pertains in general to food containers, and more particularly, to an injection molded lid including a window and adapted to seal a food container. Moreover, this invention relates to a method of forming a closure for sealing a food container.

2. Description of the Related Art

Food containers often require a lid or closure that can seal the container before and after it is first opened. Such a closure allows for piecemeal consumption of a food product over a relatively long period of time.

Occasionally, it is advantageous for food container closures to include a window so that prospective consumers may view the product before purchasing it. For example, lids with windows have been used with ice cream containers. However, it is important to maintain a sanitary seal for both the container and the window.

Traditionally, ice cream containers and lids are made of paperboard. These paperboard containers are subject to swelling and bending since they are not very sturdy. As these containers become misformed, the integrity of their seals become more and more suspect.

Likewise, a paperboard lid with a window may become misformed as well. The window is generally glued to the underside of the paperboard lid. Compounding the already difficult task of maintaining a continuous seal around the window, the glue is easily loosened by the swelling and bending of the paperboard.

SUMMARY OF THE INVENTION

It is therefore a primary object of the present invention to provide a lid for adequately sealing a food container.

It is a further object of the present invention to provide a lid that will maintain the integrity of the original seal.

It is another object of the present invention to provide a method of forming a closure for sealing a food container.

These and other objects are acheived by providing an injection molded lid comprising a closed annular rim, a skirt fixed to and extending downwardly from the rim and a film sealed to the bottom side of the rim to cover the open space within the rim. The rim and skirt are molded as a single monolithic lid preform, with the skirt being fixed near the outer peripheral edge of the rim. The film is sealed along the inner peripheral edge on the bottom side of the rim. Use of this device allows for a prospective consumer to view the contents of the container before purchasing it.

These and other objects are further achieved by providing a method of forming a closure to seal a food container. A lid preform is injection molded as a monolithic unit comprising a skirt and a closed rim. Then the film is sealed along the entire length of the inner peripheral edge on the bottom side of the rim. Use of this method allows for forming a sturdy closure capable of maintaining the integrity of its original seal with the container as well as its seal with the film.

Other and further objects of the present invention will become apparent from the following description of the invention and of the accompanying drawings.

BRIEF DESCRIPTION OF THE DRAWINGS

In the accompanying drawings which form a part of the specification and are to be read in conjunction therewith and in which like reference numerals are used to indicate like parts in the various views.

DESCRIPTION OF A PREFERRED EMBODIMENT

Figure 1:
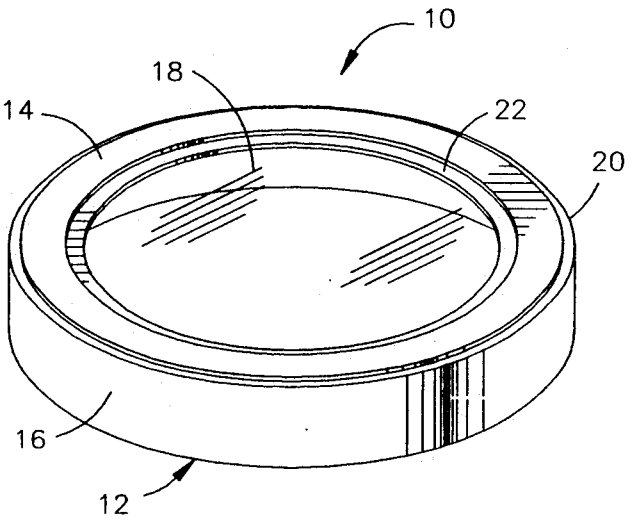
FIG. 1 is a perspective view of the device of the present invention.

Referring now to the drawings in greater detail and initially to FIG. 1, reference numeral 10 broadly designates a lid of the present invention. Lid 10 includes a film 18 and a lid preform 12 having a closed rim 14 and a skirt 16.

Lid preform 12 is a major component of lid 10. In a preferred embodiment, lid preform 12 is injection molded as a monolithic unit. Thus, lid preform 12 comprises rim 14, skirt 16, and, if applicable, shoulder 20, flange 22 and ridge 26. While injection molding plastic is preferred, the use of other materials and methods are contemplated by the present invention.

Rim 14 may be of any closed configuration, but an annular rim is preferable. Further, the rim 14 includes top and bottom sides as well as an inner peripheral edge and an outer peripheral edge.

Skirt 16 is fixed to rim 14 in proximity to the outer peripheral edge of rim 14 and extending downwardly from the bottom side of rim 14. Thus, skirt 16 is essentially of the same configuration as rim 14. So, if rim 14 is annular, then skirt 16 is essentially annular. However, skirt 16 need not be continuous, but may include a plurality of skirt segments extending downwardly from rim 14.

Additionally, lid preform 12 may include a shoulder 20 presenting a groove and positioned between skirt 16 and the outer peripheral edge of rim 14.

Preferably, film 18 is sealed to the bottom side of rim 14 in proximity to and along the entire length of the inner peripheral edge of rim 14, although film 18 may also be sealed to the top side of rim 14 or anywhere else on lid preform 12. This sealing may be by heat, ultrasonic welding, adhesive or solvent. Thus, film 18 provides a seal about the entire void created inside rim 14.

Further, rim 14 may include the flange 22 having top and bottom sides and fixed to the inner peripheral edge of rim 14. Consequently, film 18 may be sealed to the bottom side of flange 22, although film 18 may also be sealed to the top side of flange 22.

Figure 3:
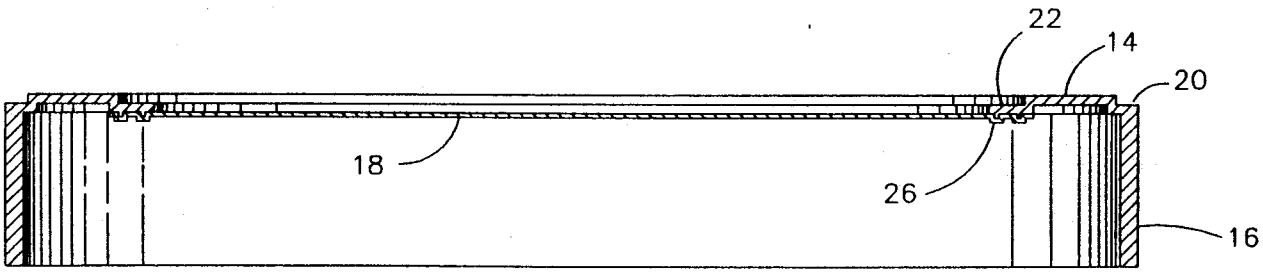
FIG. 3 is a side sectional view of the device of the present invention taken at line 3—3 of FIG. 2.

Referring now to FIG. 3, flange 22 may also include at least one ridge 26 on the side to which film 18 is to be sealed in order to provide an improved surface for sealing film 18. Preferably, each ridge 26 will extend the entire length of flange 22, but one or more ridge segments is also within the contemplation of the present invention. Likewise, a preferred plurality of ridges will be concentric to one another; however, a plurality of ridges that intersect is also contemplated.

Ridge 26 may help to develop and maintain the integrity of the seal between film 18 and lid preform 12. For example, film 18 may be heat sealed around the outside of ridge 26 such that film 18 will remain taut and essentially airtight, especially when refrigerated or frozen. Alternatively, film 18 may be sealed upon ridge 26, causing film 18 and ridge 26 to melt together to form a more permanent bond. Further, in the instance of two concentric ridges, film 18 may be sealed between the two ridges by melting the two ridges together. In yet another approach, film 18 may be sealed to the inside and outside of one or more ridges to provide a better seal.

Figure 2:
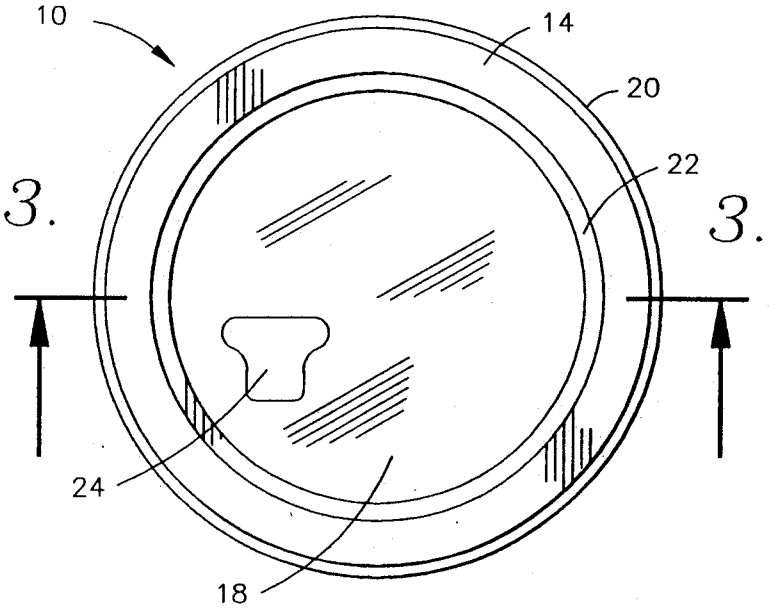
FIG. 2 is a top plan view of the device of the present invention.

Referring to FIG. 2, film 18 may include at least one area with indicia 24 printed thereon. In a preferred embodiment, film 18 is transparent, and indicia 24 is oriented so as to leave a transparent window through which the contents may be viewed. However, part or all of film 18 may be translucent or even opaque. Further, indicia 24 may essentially cover the entire film 18 or may be essentially non-existent.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without department from the scope thereof, it is to be understood that all matter herein set forth or shown in the accompanying drawings is to be interpreted as illustrative and not in a limiting sense.

What is claimed is:

1. A lid adapted to seal a food container, said lid comprising:

a closed rim presenting an inner peripheral edge and an outer peripheral edge and having top and bottom sides, said top side having a horizontally planar portion and said rim having at least one ridge portion projecting downward from said bottom side vertically opposed to the horizontally planar portion in proximity to, and spaced peripherally outward of, said inner peripheral edge;

a skirt fixed to said rim in proximity to said outer peripheral edge and extending downward from said bottom side, said skirt having an inner side and an outer side; and a film scaled at least to said at least one ridge portion on said bottom side of said rim.

2. The lid of claim 1, wherein said rim, said skirt and said ridge portion are a monolithic plastic unit, and said film is sealed to said ridge portion by means of one of the group consisting of thermal bonding and ultrasonic bonding.

3. The lid of claim 1, wherein said rim is annular.

4. The lid of claim 1, wherein said rim further includes a flange which includes said planar portion and said flange having top and bottom sides and fixed to said inner peripheral edge of said rim, said flange having an inner peripheral edge and said at least one ridge portion extending downward from said flange at a position in proximity to, and spaced peripherally outward from, said inner peripheral edge of said flange, and said film being sealed at least to said at least one ridge portion.

5. A lid as in claim 1, wherein said at least one ridge portion comprises a continuous closed peripheral ridge substantially corresponding in shape to said inner peripheral edge.

6. A lid as in claim 5, wherein said rim, skirt, and ridge are a monolithic plastic unit, and said film is sealed to said ridge portion by means of one of the group consisting of thermal bonding and ultrasonic bonding.

7. A lid as in claim 5, wherein said at least one ridge portion comprises an additional closed peripheral ridge.

8. A lid as in claim 7, wherein said rim, skirt, and ridge are a monolithic plastic unit, and said film is sealed to said ridge portion by means of one of the group consisting of thermal bonding and ultrasonic bonding.

9. A lid adapted to seal a food container, said lid comprising:

a closed rim presenting an inner peripheral edge and an outer peripheral edge and having top and bottom sides, said top side having a horizontally planar portion and said rim having at least one first and at least one second ridge portion projecting downward from said bottom side vertically opposed to the horizontally planar portion in proximity to said inner peripheral edge, said at least one first ridge portion being located peripherally outward with respect to said at least one second ridge portion;

a skirt fixed to said rim in proximity to said outer peripheral edge and extending downward from said bottom side, said skirt having an inner side and an outer side; and a film sealed at least to said at least one ridge portion on said bottom side of said rim.

10. A lid as in claim 9, wherein each said at least one first ridge portion comprises a continuous closed peripheral ridge substantially corresponding in shape to said inner peripheral edge.

11. A lid as in claim 10, wherein said rim, skirt and ridge are annular.

* * * * *